US006033327A

United States Patent [19]

Bird

[11] Patent Number: 6,033,327

[45] Date of Patent: Mar. 7, 2000

[54] VARIABLE RIGIDITY HOCKEY STICK

[76] Inventor: Timothy E. Bird, 16750 Hannan, Romulus, Mich. 48174

[21] Appl. No.: 09/116,978

[22] Filed: Jul. 16, 1998

[51] Int. Cl.[7] ..... A63B 59/14

[52] U.S. Cl. ..... 473/560

[58] Field of Search ..... 473/560–563, 473/316, 549

[56] References Cited

U.S. PATENT DOCUMENTS

| | | | |
|---|---|---|---|
| 5,263,711 | 11/1993 | Addis et al. | 473/562 |
| 5,447,306 | 9/1995 | Selden | 473/562 |
| 5,582,406 | 12/1996 | Babcock | 473/562 |
| 5,609,336 | 3/1997 | Tashjian | 473/560 |
| 5,628,509 | 5/1997 | Christian | 473/562 |
| 5,816,961 | 10/1998 | Kraemer | 473/560 |

*Primary Examiner*—Mark S. Graham

[57] ABSTRACT

A variable rigidity hockey stick for allowing a user to adjust the flexibility of the shaft of the hockey stick. The hockey stick includes an elongate tubular shaft having a lumen, upper and lower ends with a blade extending outwardly from the lower end of the shaft. An elongate stiffening bar is slidably disposed in the lumen of the shaft. The stiffening bar is slidable in the lumen of the shaft between the upper and lower ends of the shaft. A detent mechanism is provided for releasably holding the stiffening bar in a position with respect to the shaft.

9 Claims, 2 Drawing Sheets

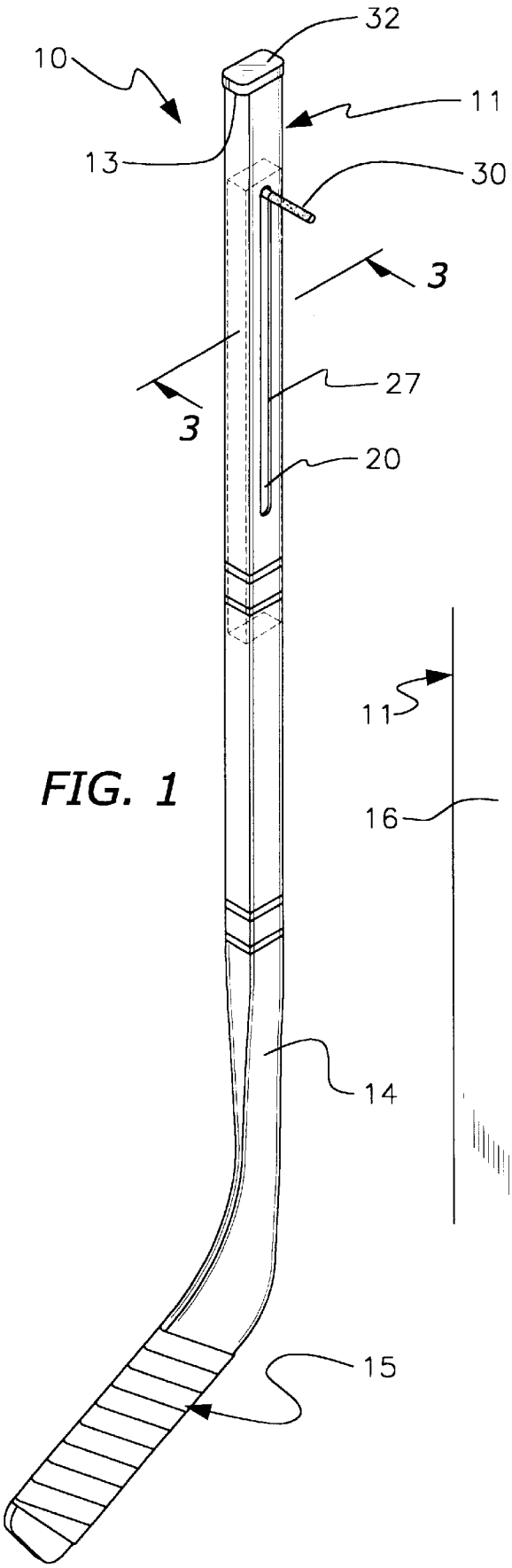
FIG. 1
FIG. 2
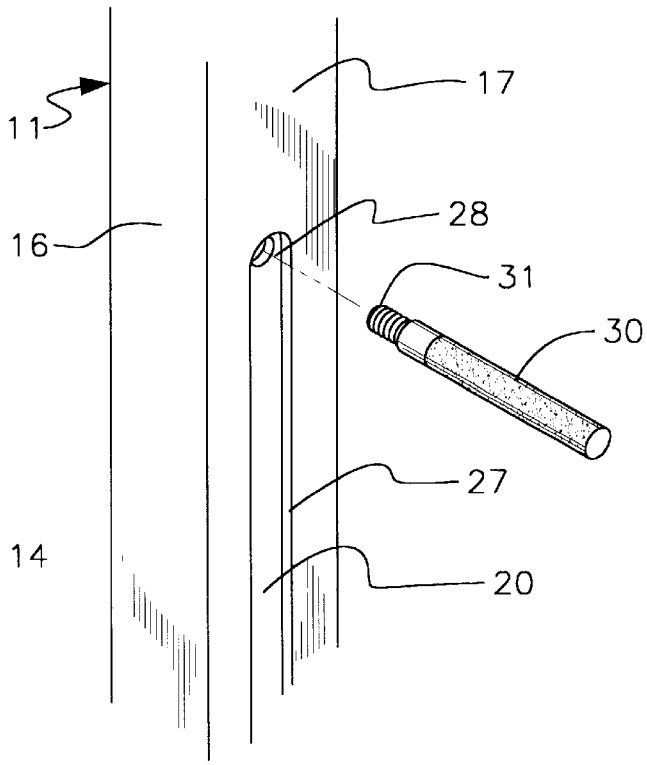

VARIABLE RIGIDITY HOCKEY STICK

BACKGROUND OF THE INVENTION

1. Field of the Invention

The present invention relates to hockey sticks and more particularly pertains to a new variable rigidity hockey stick for allowing a user to adjust the flexibility of the shaft of the hockey stick.

2. Description of the Prior Art

The use of hockey sticks is known in the prior art. More specifically, hockey sticks heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,940,134; U.S. Pat. No. 5,333,857; U.S. Pat. No. 3,712,652; U.S. Pat. No. 3,556,544; U.S. Pat. No. Des. 244,219; and U.S. Pat. No. 2,260,218.

While these devices fulfill their respective, particular objectives and requirements, the aforementioned patents do not disclose a new variable rigidity hockey stick. The inventive device includes an elongate tubular shaft having a lumen, upper and lower ends with a blade extending outwardly from the lower end of the shaft. An elongate stiffening bar is slidably disposed in the lumen of the shaft. The stiffening bar is slidable in the lumen of the shaft between the upper and lower ends of the shaft. A detent mechanism is provided for releasably holding the stiffening bar in a position with respect to the shaft.

In these respects, the variable rigidity hockey stick according to the present invention substantially departs from the conventional concepts and designs of the prior art, and in so doing provides an apparatus primarily developed for the purpose of allowing a user to adjust the flexibility of the shaft of the hockey stick.

SUMMARY OF THE INVENTION

In view of the foregoing disadvantages inherent in the known types of hockey sticks now present in the prior art, the present invention provides a new variable rigidity hockey stick construction wherein the same can be utilized for allowing a user to adjust the flexibility of the shaft of the hockey stick.

The general purpose of the present invention, which will be described subsequently in greater detail, is to provide a new variable rigidity hockey stick apparatus and method which has many of the advantages of the hockey sticks mentioned heretofore and many novel features that result in a new variable rigidity hockey stick which is not anticipated, rendered obvious, suggested, or even implied by any of the prior art hockey sticks, either alone or in any combination thereof.

To attain this, the present invention generally comprises an elongate tubular shaft having a lumen, upper and lower ends with a blade extending outwardly from the lower end of the shaft. An elongate stiffening bar is slidably disposed in the lumen of the shaft. The stiffening bar is slidable in the lumen of the shaft between the upper and lower ends of the shaft. A detent mechanism is provided for releasably holding the stiffening bar in a position with respect to the shaft.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new variable rigidity hockey stick apparatus and method which has many of the advantages of the hockey sticks mentioned heretofore and many novel features that result in a new variable rigidity hockey stick which is not anticipated, rendered obvious, suggested, or even implied by any of the prior art hockey sticks, either alone or in any combination thereof.

It is another object of the present invention to provide a new variable rigidity hockey stick which may be easily and efficiently manufactured and marketed.

It is a further object of the present invention to provide a new variable rigidity hockey stick which is of a durable and reliable construction.

An even further object of the present invention is to provide a new variable rigidity hockey stick which is susceptible of a low cost of manufacture with regard to both materials and labor, and which accordingly is then susceptible of low prices of sale to the consuming public, thereby making such variable rigidity hockey stick economically available to the buying public.

Still yet another object of the present invention is to provide a new variable rigidity hockey stick which provides in the apparatuses and methods of the prior art some of the advantages thereof, while simultaneously overcoming some of the disadvantages normally associated therewith.

Still another object of the present invention is to provide a new variable rigidity hockey stick for allowing a user to adjust the flexibility of the shaft of the hockey stick.

Yet another object of the present invention is to provide a new variable rigidity hockey stick which includes an elongate tubular shaft having a lumen, upper and lower ends with a blade extending outwardly from the lower end of the shaft.

An elongate stiffening bar is slidably disposed in the lumen of the shaft. The stiffening bar is slidable in the lumen of the shaft between the upper and lower ends of the shaft. A detent mechanism is provided for releasably holding the stiffening bar in a position with respect to the shaft.

When a hockey player hits a puck with a hockey stick, the shaft of the hockey stick flexes from the blade of the hockey stick to the hand of the hockey player closest to the blade of the hockey stick. Hockey players frequently select their hockey sticks on the basis of the rigidity of the shaft of the hockey stick when hitting a puck. Some players prefer a more flexible shaft hockey stick and others prefer a more rigid shaft hockey stick. Still yet another object of the present invention is to provide a new variable rigidity hockey stick that allows hockey players to selectively adjust the rigidity of their hockey stick according to their need.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a new variable rigidity hockey stick according to the present invention.

FIG. 2 is a schematic partial perspective view of the present invention.

DESCRIPTION OF THE PREFERRED EMBODIMENT

Figure 3:
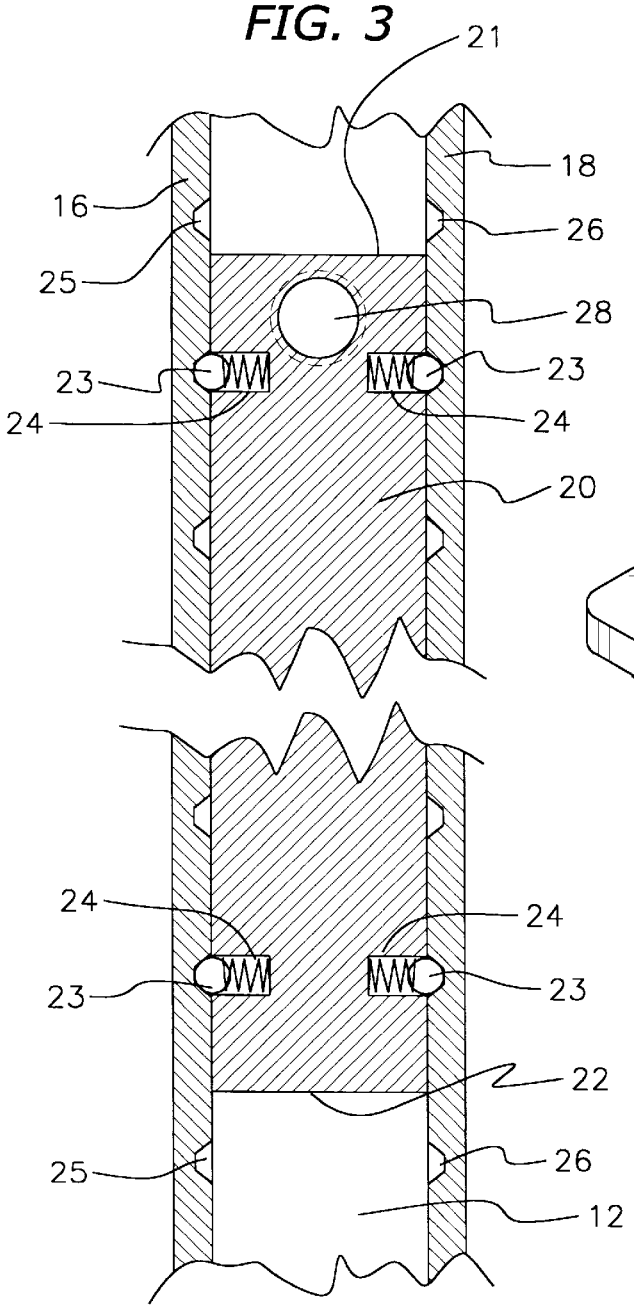
FIG. 3 is a schematic cross sectional view of the present invention taken from line 3—3 on FIG. 1.

With reference now to the drawings, and in particular to FIGS. 1 through 4 thereof, a new variable rigidity hockey stick embodying the principles and concepts of the present invention and generally designated by the reference numeral 10 will be described.

As best illustrated in FIGS. 1 through 4, the variable rigidity hockey stick 10 generally comprises an elongate tubular shaft 11 having a lumen 12, upper and lower ends 13,14 with a blade 15 extending outwardly from the lower end 14 of the shaft 11. An elongate stiffening bar 20 is slidably disposed in the lumen 12 of the shaft 11. The stiffening bar 20 is slidable in the lumen 12 of the shaft 11 between the upper and lower ends 13,14 of the shaft 11. A detent mechanism is provided for releasably holding the stiffening bar 20 in a position with respect to the shaft 11.

In closer detail, the hockey stick 10 includes an elongate tubular shaft 11 having a lumen 12, upper and lower ends 13,14, and a longitudinal axis extending between the upper and lower ends 13,14 of the shaft 11. The shaft 11 preferably comprises a metal such as an aluminum metal with a blade 15 extending outwardly from the lower end 14 of the shaft 11. The shaft 11 has a generally rectangular cross section taken generally perpendicular to the longitudinal axis of the shaft 11 such that the lumen 12 of the shaft 11 has a generally rectangular cross section taken from generally perpendicular to the longitudinal axis of the shaft 11. The shaft 11 has four of side walls 16,17,18,19 comprising a spaced apart first pair of side walls 16,18 and a spaced apart second pair of side walls 17,19. The side walls 16,18 of the first pair of side walls are generally parallel to one another and the side walls 17,19 of the second pair of side walls are generally parallel to one another and generally perpendicular to the first pair of side walls.

An elongate stiffening bar 20 is slidably disposed in the lumen 12 of the shaft 11. The stiffening bar 20 preferably comprises a solid metal bar such as an aluminum metal. The stiffening bar 20 has top and bottom ends 21,22 and a longitudinal axis extending between the top and bottom ends 21,22 of the stiffening bar 20. The top end 21 of the stiffening bar 20 is positioned towards the upper end 13 of the shaft 11 and the bottom end 22 of the stiffening bar 20 is positioned towards the lower end 14 of the shaft 11. The stiffening bar 20 has a generally rectangular cross section taken generally perpendicular to the longitudinal axis of the stiffening bar 20 and is sized to conform to the shape of the lumen 12 of the shaft 11. The stiffening bar 20 has four sides including a first pair of parallel generally sides and a second pair of generally parallel sides. The stiffening bar 20 is slidable in the lumen 12 of the shaft 11 along the length of the shaft 11 between the upper and lower ends 13,14 of the shaft 11. In use, the closer the stiffening bar 20 is to the lower end 14, the stiffer and more rigid the shaft 11 while the closer the stiffening bar 20 is to the upper end 13, the less stiff and more flexible is the shaft 11.

A detent mechanism is provided for releasably holding the stiffening bar 20 in a position with respect to the shaft 11 so that a user can keep the hockey stick at the desired stiffness. The detent mechanism includes a plurality of spring biased members 23 and a plurality of spaced apart recesses 25,26 for receiving the spring biased members 23. The plurality of spring biased members 23 are provided in bores 24 in the stiffening bar 20. As illustrated in FIG. 3, a first pair of spring biased members are provided in bores located in one side of the first pair of sides of the stiffening bar 20 while a second pair of spring biased members are provided in bores located in the other side of the first pair of sides of the stiffening bar 20. Preferably, one spring biased member of each pair of spring biased members is positioned towards the top end 21 of the stiffening bar 20 while the other spring biased member of each pair of spring biased members is positioned towards the bottom end 22 of the stiffening bar 20.

As illustrated in FIG. 3, the recesses 25,26 are provided in the lumen 12 of the shaft 11. The recesses 25,26 are arranged in first and second rows extending along the length of the shaft 11. The first row of recesses 25 is located on one side wall 16 of the first pair of side walls of the shaft 11 facing the first pair of spring biased members while the second row of recesses 26 is located on another side wall 18 of the first pair of side walls of the shaft 11 facing the second pair of spring biased members. Preferably, the recesses of each row are spaced apart in generally equal intervals in each row. Each of the spring biased members 23 is biased in a direction so that they are each insertable into a recess to releasably hold the stiffening bar 20 in a position with respect to the shaft 11.

The shaft 11 has a length defined between the upper and lower ends 13,14 of the shaft 11 while the length of the stiffening bar is defined between the top and bottom ends 21,22 of the stiffening bar 20. Preferably, the length of the stiffening bar 20 is between one-fifth and four-fifths the length of the shaft 11. Even more preferably, the length of the stiffening bar 20 is less than one-half the length of the shaft 11. Ideally, the length of the stiffening bar 20 is about 15 cm for standard-sized hockey sticks.

As best illustrated in FIGS. 1 and 2, one of the side walls 17 of the second pair of side walls of the shaft has an elongate slot 27 therethrough providing an opening into the lumen 12 of the shaft 11. The slot 27 has a length extending between the upper and lower ends 13,14 of the shaft 11 with the slot 27 positioned towards the upper end 13 of the shaft 11. The stiffening bar 20 has a threaded bore 28 therein. In this preferred embodiment, the threaded bore 28 of the stiffening bar 20 is located on one of the sides of the second pair of sides of the stiffening bar 20. The threaded bore 28 of the stiffening bar 20 is positioned adjacent the slot 27 of the shaft 11 such that the threaded bore 28 travels along the length of the slot 27 as the stiffening bar 20 is slid in the lumen 12 of the shaft 11. An adjustment rod 30 is provided having a threaded end 31 which is insertable through the slot 27 of the shaft 11 and threadably inserted into the threaded bore 28 of the stiffening bar 20 such that the adjustment rod 30 outwardly extends from the slot 27 of the shaft 11. Ideally, the adjustment bar extends generally perpendicular to the stiffening bar 20 in this embodiment. In use, the adjustment rod 30 is designed for permitting a user to move the stiffening bar 20 along the length of the lumen 12 of the shaft 11.

Figure 4:
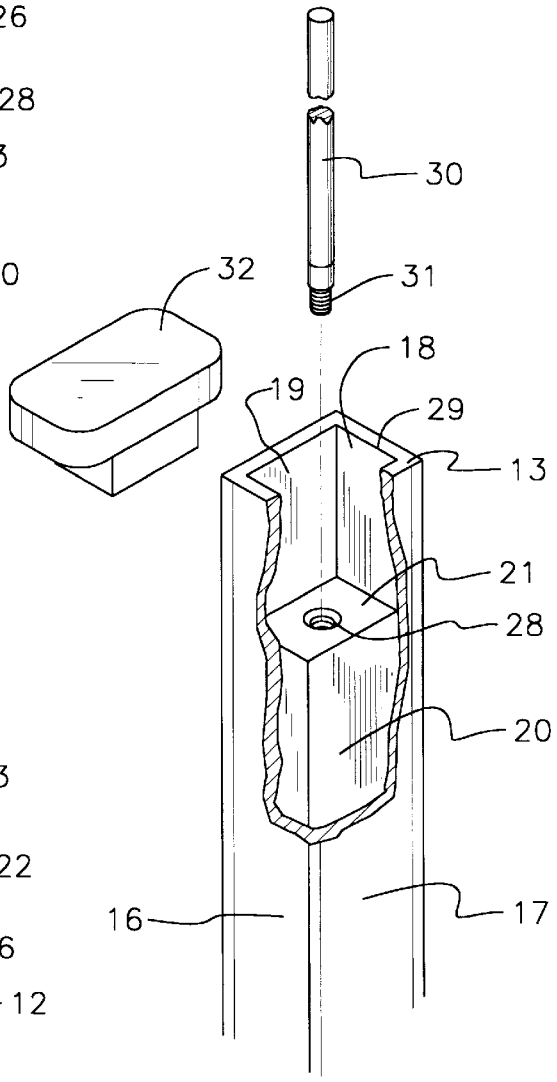
FIG. 4 is a schematic partial perspective view of another preferred embodiment of the present invention.

In another preferred embodiment, as illustrated in FIG. 4, the upper end 13 of the shaft 11 has an opening 29 into the lumen 12 and the threaded bore 28 of the stiffening bar is located on the top end 21 of the stiffening bar 20. The threaded end 31 of the adjustment rod 30 is insertable through the opening 29 of the upper end 13 of the shaft 11 and threadably inserted into the threaded bore 28 of the stiffening bar 20 such that the adjustment rod 30 outwardly extends from the opening of the upper end 13 of the shaft 11. Preferably, the adjustment bar extends generally parallel to the longitudinal axis of the shaft 11. In this embodiment, an end cap 32 is provided for substantially closing the opening of the upper end 13 of the shaft 11 when the adjustment rod 30 is removed As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hockey stick, comprising:

an elongate tubular shaft having a lumen, upper and lower ends, and a longitudinal axis extending between said upper and lower ends of said shaft;

a blade extending outwardly from said lower end of said shaft;

an elongate stiffening bar being slidably disposed in said lumen of said shaft;

said stiffening bar being slidable in said lumen of said shaft between said upper and lower ends of said shaft;

a detent mechanism for holding said stiffening bar in a position with respect to said shaft;

wherein said detent mechanism comprises a plurality of spring biased members and a plurality of spaced apart recesses, each of said spring biased members being insertable into a recess to hold said stiffening bar in a position with respect to said shaft.

2. The hockey stick of claim 1, wherein said shaft has a generally rectangular cross section taken generally perpendicular to said longitudinal axis of said shaft such that said lumen of said shaft has a generally rectangular cross section taken from generally perpendicular to said longitudinal axis of said shaft, and wherein said stiffening bar having a generally rectangular cross section taken generally perpendicular to said longitudinal axis of said stiffening bar.

3. The hockey stick of claim 1, wherein said plurality of spring biased members are provided in bores in said stiffening bar, wherein said recesses are provided in said lumen of said shaft, said recesses being arranged in first and second rows extending along said length of said shaft.

4. A hockey stick, comprising:

an elongate tubular shaft having a lumen, upper and lower ends, and a longitudinal axis extending between said upper and lower ends of said shaft;

a blade extending outwardly from said lower end of said shaft;

an elongate stiffening bar being slidably disposed in said lumen of said shaft;

said stiffening bar being slidable in said lumen of said shaft between said upper and lower ends of said shaft;

a detent mechanism for holding said stiffening bar in a position with respect to said shaft;

wherein said shaft has an elongate slot therethrough, said slot having a length extending between said upper and lower ends of said shaft, said slot being positioned towards said upper end of said shaft, said stiffening bar having a threaded bore therein, said threaded bore of said stiffening bar being positioned adjacent said slot of said shaft such that said threaded bore travels along said length of said slot as said stiffening bar is slid in said lumen of said shaft, and wherein an adjustment rod is provided having a threaded end, said threaded end of said adjustment rod being insertable through said slot of said shaft and threadably inserted into said threaded bore of said stiffening bar such that said adjustment rod outwardly extends from said slot of said shaft.

5. A hockey stick, comprising:

an elongate tubular shaft having a lumen, upper and lower ends, and a longitudinal axis extending between said upper and lower ends of said shaft;

a blade extending outwardly from said lower end of said shaft;

said shaft having a generally rectangular cross section taken generally perpendicular to said longitudinal axis of said shaft such that said lumen of said shaft has a generally rectangular cross section taken from generally perpendicular to said longitudinal axis of said shaft;

said shaft having a plurality of side walls, said plurality of side walls comprising a spaced apart first pair of side walls and a spaced apart second pair of side walls, the side walls of said first pair of side walls being generally parallel to one another, the side walls of said second pair of side walls being generally parallel to one another and generally perpendicular to said first pair of side walls;

an elongate stiffening bar being slidably disposed in said lumen of said shaft;

said stiffening bar having top and bottom ends and a longitudinal axis extending between said top and bottom ends of said stiffening bar;

said top end of said stiffening bar being positioned towards said upper end of said shaft, said bottom end of said stiffening bar being positioned towards said lower end of said shaft;

said stiffening bar having a generally rectangular cross section taken generally perpendicular to said longitudinal axis of said stiffening bar;

said stiffening bar having four sides comprising a first pair of parallel generally sides and a second pair of generally parallel sides;

said shaft having a length defined between said upper and lower ends of said shaft;

said stiffening bar having a length defined between said top and bottom ends of said stiffening bar;

said stiffening bar being slidable in said lumen of said shaft between said upper and lower ends of said shaft;

a detent mechanism for holding said stiffening bar in a position with respect to said shaft;

said detent mechanism comprising a plurality of spring biased members and a plurality of spaced apart recesses;

said plurality of spring biased members being provided in bores in said stiffening bar;

a first pair of spring biased members being provided in bores located in one side of said first pair of sides of said stiffening bar, a second pair of spring biased members being provided in bores located in another side of said first pair of sides of said stiffening bar;

one spring biased member of each pair of spring biased members being positioned towards said top end of said stiffening bar, another spring biased member of each pair of spring biased members being positioned towards said bottom end of said stiffening bar;

said recesses being provided in said lumen of said shaft, said recesses being arranged in first and second rows extending along said length of said shaft;

said first row of recesses facing said first pair of spring biased members, said second row of recesses facing said second pair of spring biased members;

said recesses of each row being spaced apart in generally equal intervals;

each of said spring biased members being insertable into a recess to hold said stiffening bar in a position with respect to said shaft;

said shaft having an elongate slot therethrough, said slot having a length extending between said upper and lower ends of said shaft, said slot being positioned towards said upper end of said shaft;

said stiffening bar having a threaded bore therein, said threaded bore of said stiffening bar being located on one of said sides of said second pair of sides of said stiffening bar, said threaded bore of said stiffening bar being positioned adjacent said slot of said shaft such that said threaded bore travels along said length of said slot as said stiffening bar is slid in said lumen of said shaft; and an adjustment rod having a threaded end, said threaded end of said adjustment rod being insertable through said slot of said shaft and threadably inserted into said threaded bore of said stiffening bar such that said adjustment rod outwardly extends from said slot of said shaft.

6. The hockey stick of claim 1, wherein said upper end of said shaft has an opening into said lumen, said stiffening bar having a threaded bore therein, said threaded bore of said stiffening bar being located on a top end of said stiffening bar, wherein an adjustment rod is provided having a threaded end, said threaded end of said adjustment rod being insertable through said opening of said upper end of said shaft and threadably inserted into said threaded bore of said stiffening bar such that said adjustment rod outwardly extends from said opening of said upper end of said shaft.

7. The hockey stick of claim 6, wherein said detent mechanism comprises a plurality of spring biased members and a plurality of spaced apart recesses, each of said spring biased members being insertable into a recess to hold said stiffening bar in a position with respect to said shaft.

8. The hockey stick of claim 6, wherein said shaft has a generally rectangular cross section taken generally perpendicular to said longitudinal axis of said shaft such that said lumen of said shaft has a generally rectangular cross section taken from generally perpendicular to said longitudinal axis of said shaft, and wherein said stiffening bar having a generally rectangular cross section taken generally perpendicular to said longitudinal axis of said stiffening bar.

9. The hockey stick of claim 3, wherein said plurality of spring biased members are provided in bores in said stiffening bar, wherein said recesses are provided in said lumen of said shaft, said recesses being arranged in first and second rows extending along said length of said shaft.

* * * * *